US005937463A

United States Patent [19]

Hutton et al.

[11] Patent Number: 5,937,463

[45] Date of Patent: Aug. 17, 1999

[54] HANDLE STRUCTURE FOR A MATTRESS

[76] Inventors: William B. Hutton; Deanice B. Hutton, both of 330 Riverside Dr., St. Helens, Oreg. 97051

[21] Appl. No.: 08/963,960

[22] Filed: Nov. 4, 1997

[51] Int. Cl.[6] ..... A47C 31/08

[52] U.S. Cl. ..... 5/703; 16/DIG. 28

[58] Field of Search ..... 5/699, 703, 704; 16/DIG. 28

[56] References Cited

U.S. PATENT DOCUMENTS 773,835 11/1904 White ..... 16/DIG. 28
2,715,229 8/1955 Hirschman ..... 5/703
3,302,221 2/1967 Zysman ..... 5/203
3,514,797 6/1970 Zysman ..... 5/203
5,632,054 5/1997 Hutton et al. ..... 5/203 X

*Primary Examiner*—Michael F. Trettel
*Attorney, Agent, or Firm*—Smith-Hill and Bedell

[57] ABSTRACT

A mattress handle is made of synthetic polymer material and has a medial grasping portion and two opposite end attachment portions. Each attachment portion includes a membrane of synthetic polymer material, and the handle is attached to the mattress wall at each attachment portion by stitching through the membrane.

8 Claims, 1 Drawing Sheet

HANDLE STRUCTURE FOR A MATTRESS

BACKGROUND OF THE INVENTION

This invention relates to a handle structure for a mattress.

A conventional mattress, whether of twin, double, queen or king size, is generally parallelepipedal in form and has top and bottom surfaces and a peripheral wall. The top and bottom and the peripheral wall of the mattress are made of fabric known as tick. A decorative tape is used to bind the seams joining the wall to the top and bottom of the mattress.

It is conventional to attach handles to the wall of the mattress to facilitate lifting and turning of the mattress. A common form of handle is illustrated in U.S. Pat. No. 2,248,328 and comprises a flexible cord having a tubular ferrule at each end, each ferrule being provided with a projecting finger or barb. Two grommets are fitted in the mattress wall, about five inches apart and are linked by a backing bar of steel or tough synthetic polymer material. The tubular ferrules are inserted through the grommets respectively and are held in position by the barbs, which hook behind the grommets. The backing bar serves to protect the mattress wall from damage by the barb.

For many years, inner spring and foam mattresses were manufactured with a standard thickness of approximately seven inches. Recently, however, mattresses that are substantially thicker than seven inches, even up to about sixteen inches in thickness, have been manufactured in order to capture the luxury market, which is driven by demand for greater comfort and superior back support. Since the structure of the newer thicker mattress is the same as that of the older standard mattresses, the newer mattress contains much more material and accordingly the newer mattress is much heavier than the older standard mattress. Further, some mattresses are now made of a latex material and a mattress made of latex material can be substantially heavier than an innerspring or foam mattress of the same size and thickness.

The conventional type of handle, as described in U.S. Pat. No. 2,248,328 functions well with a mattress of the standard thickness and of conventional (innerspring or foam) construction but it may become detached from the wall of a heavier mattress when the mattress is lifted or turned. Further, the cord of the conventional handle tends to dig into the hand of the person lifting or turning the mattress, and in the case of a heavier mattress, this may cause discomfort and even injury.

In order to alleviate the problems of the conventional handle, it has been proposed that a mattress handle should be made from a strap of fabric having two end regions by which the strap is sewn securely to the mattress wall. In a particular instance of this type of handle, the end regions of the strap are square in configuration and each end region is sewn to the mattress wall along all four sides of the square, along the two diagonals and along a line midway between the upper and lower sides of the square. This type of handle, and its manner of attachment, overcome the disadvantages of the conventional handle. However, it has proven impractical to automate the operation by which the handle is placed on the mattress wall and the end regions of the handle are sewn to the mattress wall and therefore it is necessary for an operator to position the strap and guide the sewing machine head along the desired path. Consequently, it is expensive and time consuming to attach the handle to the mattress wall by sewing in accordance with the pattern described above. Moreover, aesthetic considerations necessitate that the fabric of the handle should match the pattern of the mattress wall. A given mattress manufacturer may use a large number of different patterns for mattress walls, and therefore the manufacturer must either keep a large inventory of straps, in which case keeping track of the inventory is difficult, or make the straps concurrently with other components of the mattress, which may be inconvenient. Further, the structure of the strap itself is rather complex, and so it is difficult to make the straps economically.

SUMMARY OF THE INVENTION

In accordance with the invention there is provided a mattress including a mattress wall and at least one handle attached thereto, wherein the handle is made of synthetic polymer material and has a medial grasping portion and two opposite end attachment portions, each attachment portion includes a membrane of synthetic polymer material, and the handle is attached to the mattress wall at each attachment portion by stitching through the membrane.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

A broad web of border material wound on a roll is unwound and the web is slit longitudinally into several strips and the edges of each strip are serged to limit fraying of the strips and the possibility of a loose thread being caught in the machinery used for subsequent processing of border material. The strips of serged border material are wound onto rolls. Each roll is delivered to an unwinding station, at which the strip of border material is unwound and cut into several segments. The length of each segment is suitable for forming the border of one mattress and depends on the size of mattress that is to be made (twin, full, king or queen).

Each length segment of border material is passed to a stitching station at which four handles are attached to the length segment and the two ends of the segment are stitched together to form an endless band. The band is delivered to a station at which it is fitted to a subassembly comprising a mattress top and bottom and a mattress interior, such as metal springs or a suitable springy block of polymer material. The band is sewn along its edges to the peripheries of the mattress top and bottom and strips of decorative tape are sewn along the seams at which the band meets the mattress top and bottom, thus completing a mattress.

Figure 1:
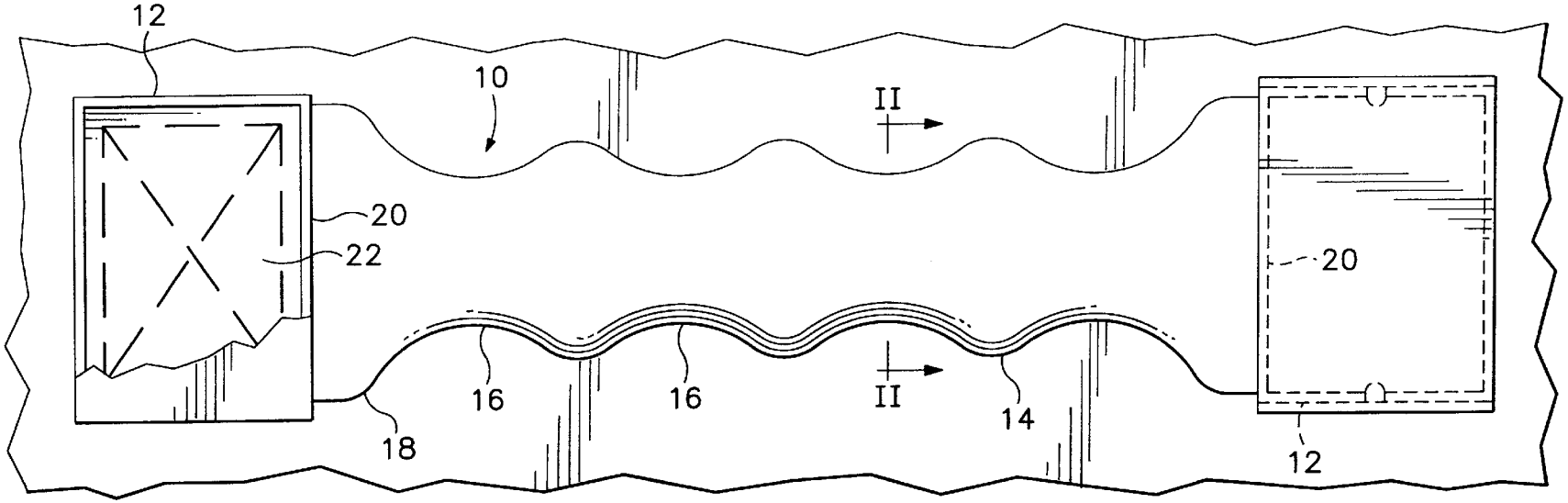
FIG. 1 is a front elevation of a mattress handle in accordance with the present invention.
Figure 3B:
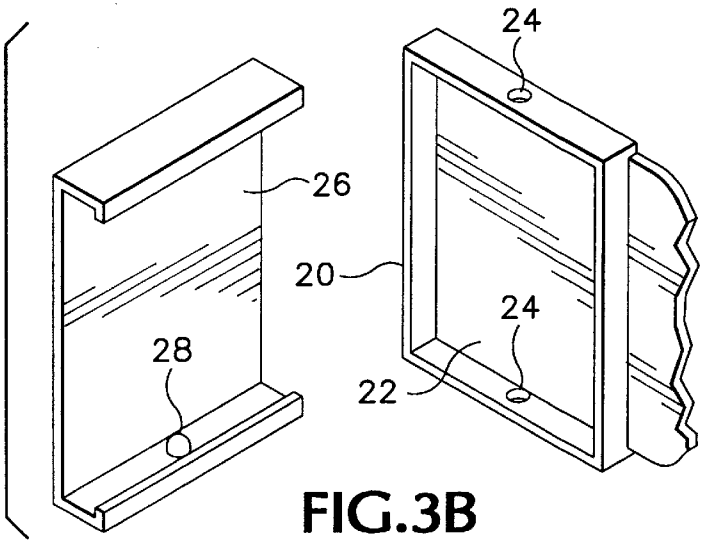
FIG. 3B is an exploded view of the detail shown in FIG. 3A.
Figure 3A:
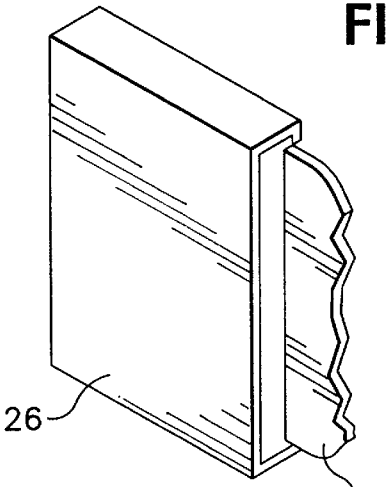
FIG. 3A is a perspective view of a detail of the mattress handle shown in FIG. 1.
Figure 2:
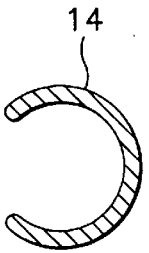
FIG. 2 is a sectional view taken on the line II—II of FIG. 1.

The mattress handle shown in FIG. 1 comprises a strap 10 which has two attachment portions 12, each about 1.5 inches long, at opposite respective ends of the strap separated by a medial portion 14 about 6 inches long. The strap is made of synthetic polymer material, such as polypropylene, polyethylene or PVC, and is formed by injection molding. Over most of its length, the medial portion 14 of the strap is substantially C-shaped in cross-section as shown in FIG. 2; and the medial portion has finger indentations 16 to allow the handle to be gripped without discomfort to the person lifting the mattress. The attachment portions 12 are generally flat and the medial portion 14 of the strap is formed at its ends with transitions 18 from the C-shaped cross-section to the generally flat attachment portions.

Each attachment portion 12 has a relatively thick frame 20 surrounding a relatively thin membrane 22. The membrane 22, although thinner than the frame 20, is nevertheless tough and cannot be easily be torn. Depending on the material from which the strap is made, the membrane may be one-sixteenth inch or less in thickness.

The strap 10 is attached to the border material by stitching through the membrane 22. Thus, the operator at the stitching station guides a sewing machine to stitch through the membrane along a path suitable for securing the strap to the border material. For example, as shown in FIG. 1, the path might extend around the periphery of the membrane, just inward of the frame, and include two additional diagonal segments.

At its upper and lower edges, the frame 20 has respective holes 24 which are formed during molding of the strap. An end cap 26, which is sized to fit over the frame 20, has two internally projecting snapfit bosses 28. When the strap has been attached to the border material so as to provide a handle, the end cap 26 can be fitted over the frame 20 and the snapfit bosses 28 are snapped into the holes 24 to retain the end cap in position. The end cap also is made of synthetic polymer material by injection molding and preferably bears design elements, such as the manufacturer's trademark or a logo, formed in the synthetic polymer material of the end cap during the injection molding process.

The decorative tape that is used to bind the seams between the border material and the top and bottom of the mattress is generally uniform in color, i.e. unpatterned, and relatively few colors are commercially used. It is preferred that the strap 10 be uniform in color and that the color of the strap be coordinated with the tape. For example, the strap may be substantially the same color as the tape or may be a complementary color.

It will be appreciated that the invention is not restricted to the particular embodiment that has been described, and that variations may be made therein without departing from the scope of the invention as defined in the appended claims and equivalents thereof.

We claim:

1. A mattress including a mattress wall and at least one handle attached thereto, wherein the handle is made of synthetic polymer material and has a medial grasping portion and two opposite end attachment portions, each attachment portion includes a membrane of synthetic polymer material, the handle is attached to the mattress wall at each attachment portion by at least one attachment element passing through the membrane, and an end cap is fitted to each attachment portion.

2. A mattress according to claim 1, wherein each attachment portion of the handle includes a frame surrounding the membrane and the frame is thicker than the membrane.

3. A mattress according to claim 1, wherein the end caps are releasable snapfit to the attachment portions.

4. A mattress according to claim 1, wherein the membrane is substantially rectangular and the attachment element is stitching through the membrane along a path around the rectangular periphery of the membrane.

5. A mattress including a mattress wall and at least one handle attached thereto, wherein the handle is made of synthetic polymer material and has a medial grasping portion and two opposite end attachment portions, each attachment portion includes a membrane of synthetic polymer material, the handle is attached to the mattress wall at each attachment portion by stitching through the membrane, each attachment portion of the handle includes a frame surrounding the membrane, and the frame is thicker than the membrane.

6. A mattress according to claim 5, further comprising an end cap fitted to each attachment portion.

7. A mattress according to claim 6, wherein the end caps are releasable snapfit to the attachment portions.

8. A mattress according to claim 5, wherein the membrane is substantially rectangular and the handle is attached to the mattress wall by stitching through the membrane along a path around the rectangular periphery of the membrane.

* * * * *